US009033692B2

(12) United States Patent
Glawion

(10) Patent No.: US 9,033,692 B2
(45) Date of Patent: May 19, 2015

(54) SPINNERET FOR WET SPINNING

(75) Inventor: Erwin Glawion, Grossostheim (DE)

(73) Assignee: TRÜTZSCHLER NONWOVENS & MAN-MADE-FIBERS GMBH, Egelsbach (DE)

( * ) Notice: Subject to any disclaimer, the term of this patent is extended or adjusted under 35 U.S.C. 154(b) by 0 days.

(21) Appl. No.: 14/110,925

(22) PCT Filed: Apr. 13, 2012

(86) PCT No.: PCT/EP2012/056801

§ 371 (c)(1),
(2), (4) Date: Oct. 10, 2013

(87) PCT Pub. No.: WO2012/143298

PCT Pub. Date: Oct. 26, 2012

(65) Prior Publication Data

US 2014/0044820 A1 Feb. 13, 2014

(30) Foreign Application Priority Data

Apr. 19, 2011 (DE) ..... 10 2011 018 223

(51) Int. Cl.

| | |
|---|---|
| ***D01D 4/06*** | (2006.01) |
| ***D01D 4/02*** | (2006.01) |
| ***D01D 5/06*** | (2006.01) |

(52) U.S. Cl.

CPC ..... *D01D 4/027* (2013.01); *D01D 4/02* (2013.01); *D01D 4/06* (2013.01); *D01D 5/06* (2013.01)

(58) Field of Classification Search

USPC ..... 425/71, 72.2, 192 S, 198, 382.2, 464

See application file for complete search history.

(56) References Cited

U.S. PATENT DOCUMENTS

| | | | | |
|---|---|---|---|---|
| 2,051,861 | A | 8/1936 | Jones | |
| 2,923,970 | A * | 2/1960 | Genovese | 425/464 |
| 3,221,088 | A * | 11/1965 | Martin | 264/181 |
| 3,341,891 | A | 9/1967 | Shimizu et al. | |
| 3,553,774 | A * | 1/1971 | Ruck et al. | 425/131.5 |
| 6,176,696 | B1 * | 1/2001 | Glawion et al. | 425/72.2 |
| 6,284,174 | B1 * | 9/2001 | Ueda et al. | 264/104 |

FOREIGN PATENT DOCUMENTS

| | | |
|---|---|---|
| DE | 752863 | 1/1942 |
| DE | 199 35 327 A1 | 2/2001 |
| GB | 402450 A | 12/1933 |
| JP | 57-66110 A | 4/1982 |

* cited by examiner

*Primary Examiner* — Yogendra Gupta
*Assistant Examiner* — Joseph Leyson
(74) *Attorney, Agent, or Firm* — Antonelli, Terry, Stout & Kraus, LLP

(57) ABSTRACT

In a wet spinning spinneret comprising a housing which, together with a spinneret plate mounted to the underside thereof, forms a chamber adapted to be supplied with a spinning solution, the spinneret plate having nozzle openings in at least an annular region, and a displacing member arranged inside the chamber above the spinneret plate, which member directs the spinning solution towards the annular zone, it is provided that the displacing member (VK) is attached at a support (TP) arranged upstream of the spinneret plate (SP), seen in the flow direction of the spinning liquid.

9 Claims, 2 Drawing Sheets

SPINNERET FOR WET SPINNING

BACKGROUND OF THE INVENTION

The invention refers to a spinneret for wet spinning.

A spinneret for wet spinning is known from DE 199 35 327 A1 that comprises a spinneret plate with a plurality of nozzle openings. The nozzle plate, which is designed like the bottom of a pot, is attached to the underside of a housing to which the solution to be spun is supplied. The nozzle openings are arranged in four sectors separated by channels. It is the function of the channels to allow a concentrated precipitation bath, which is as homogeneous as possible, to flow around the freshly spun filaments, i.e. to allow the filaments leaving from the inner region of the nozzle plate to be exposed as far as possible to the same coagulation conditions as the filaments in the outer region.

U.S. Pat. No. 2,051,861 describes a wet spinning spinneret with a spinneret plate wherein the nozzle openings are arranged in an annular zone. The spinneret plate mounted to the underside of a housing has a displacing member associated thereto inside the housing, which displacing member guides the flow of spinning solution into the nozzle opening zone and which is arranged as a cylinder or a truncated cone between the inner side of the spinneret plate and a sieve or filter layer extending inside the housing and parallel to the spinneret plate. The upper end of this displacing member terminates in an end portion at the sieve or filter layer, the end portion extending parallel to the sieve or filter layer.

DE 75 28 63 U describes a wet spinning spinneret in a coagulation bath, comprising a circular nozzle plate and a flow deflection device opposite the nozzle plate, by means of which the freshly spun filaments, in particular those spun in the central region of the nozzle plate, are supplied with fresh coagulation liquid. The flow deflection device is a tube closed on one side, whose symmetry axis is directed perpendicularly to the centre of the nozzle plate and is thus placed in the flow of freshly spun filaments. On the shell side, the tube has outflow openings for the coagulation liquid.

SUMMARY OF THE INVENTION

Thus, the invention starts from a wet spinning spinneret comprising a housing which, together with a spinneret plate mounted to the underside thereof, forms a chamber adapted to be supplied with a spinning solution, the spinneret plate having nozzle openings in at least an annular region, and further comprising a displacing member arranged inside the chamber above the spinneret plate, which member directs the spinning solution towards the annular zone.

It is an object of the invention to improve a generic device.

The object is achieved by providing a wet spinning spinneret including a housing which, together with a spinneret plate mounted to the underside thereof, forms a chamber adapted to be supplied with a spinning solution, the spinneret plate having nozzle openings in at least an annular region, and a displacing member arranged inside the chamber above the spinneret plate, which member directs the spinning solution towards the annular zone. The displacing member is attached at a support arranged upstream of the spinneret plate, seen in the flow direction of the spinning liquid. One advantageous developments of the invention is that the support is designed as a support plate with a plurality of flow channels. Another advantageous development of the invention is that a filter plate to be flown through by the spinning liquid is arranged upstream of the support. Another advantageous development of the invention is that the displacing member is designed as a screw connection passing through the support plate. Another advantageous development of the invention is that the part of the displacing member above the support plate is formed as a pointed head of a nut. Another advantageous development of the invention is that a flow deflection device is arranged opposite the spinneret plate in the spinning bath, by which device coagulation liquid can be introduced into the central portion, which has no nozzle openings, during the spinning process. Another advantageous development of the invention is that the flow deflection device is shaped as a tube having outlet openings in its shell surface for the coagulation liquid.

The invention provides that the displacing member is attached at a support arranged upstream of the spinneret plate, seen in the flow direction of the spinning liquid. This support is designed, in particular, as a support plate made permeable by means of a plurality of channels, which plate is arranged on the underside of the housing and which has the spinneret plate mounted to its side facing away from the housing.

Preferably, the displacing member is configured as a screw connection passing through the support plate, the end facing towards the spinning solution supply being convex and preferably pointed. The part of the screw connection at the underside of the support plate is cylindrical, having a plane base against which the rear side of the spinneret plate flatly abuts with its central part which is not provided with nozzle openings.

Another preferred development of the invention provides that a sieve or filter layer in the form of a microporous filter plate is arranged upstream of the plate, seen in the flow direction of the spinning liquid. The displacing member constructed as a screw connection also passes through this filter plate and fixes it.

Summarizing, the contemplated developments of the invention are as follows:

- the support is formed as a support plate with a number of flow channels.
- a filter plate to be flown through by the spinning liquid is arranged upstream of the support.
- the displacing member is formed as a screw connection passing through the support plate.
- the part of the screw connection above the support plate is formed as a pointed head of a nut.
- within the spinning bath, a flow deflection device is arranged opposite the spinneret plate, by means of which device coagulation liquid can be supplied into the central part during the spinning operation, the central part lacking nozzle openings.
- the flow deflection device is formed as a tube with outlet openings for the coagulation liquid in its shell surface.

BRIEF DESCRIPTION OF THE SEVERAL VIEWS OF DRAWINGS

DETAILED DESCRIPTION OF THE INVENTION

Figure 1:
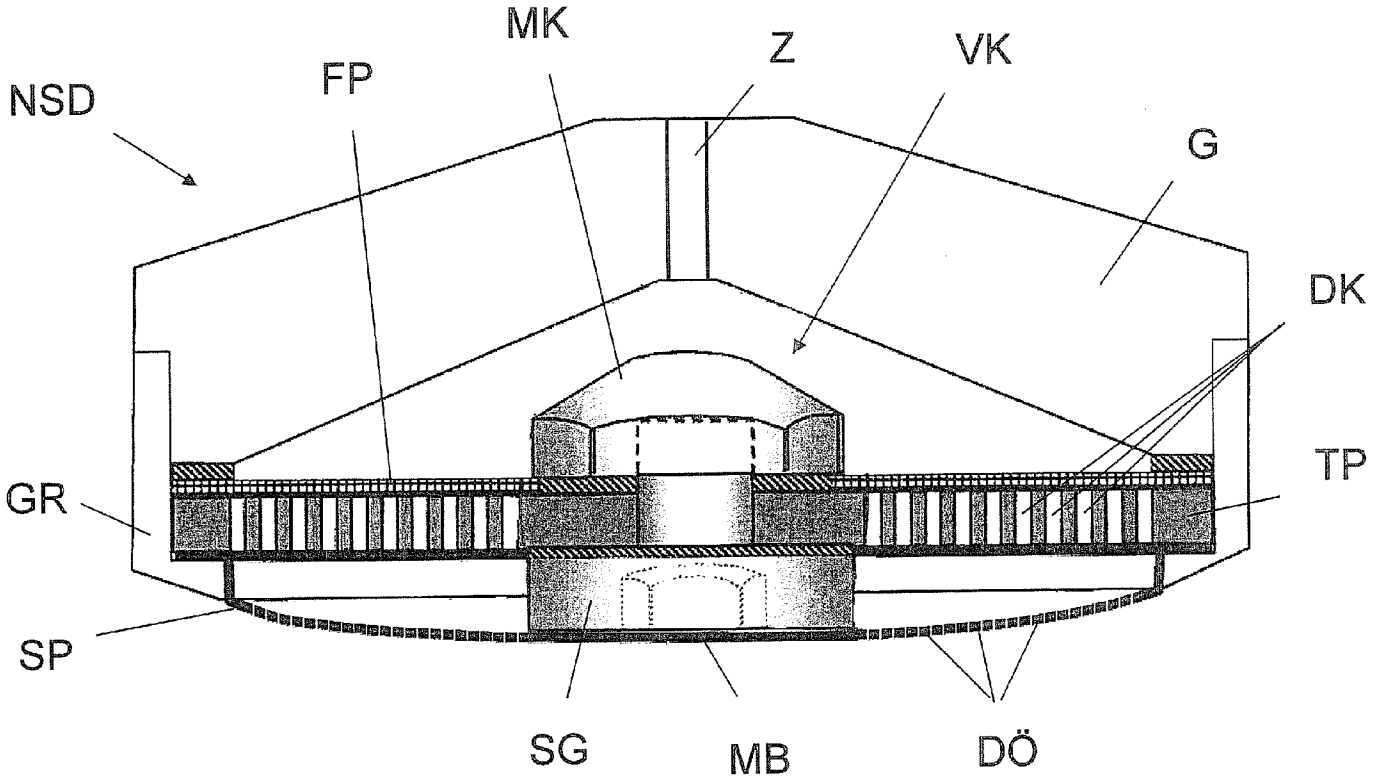
FIG. 1 shows a wet spinning spinneret of the present invention.

FIG. 1 shows a wet spinning spinneret NSD with a downwardly open housing G of the bell-like type. In the top part, the housing G has an inlet Z for the spinning solution to be spun. In the lower part, a support plate TP is set into the opening of the housing G, which has a plurality of flow channels DK in an annular zone. Above the support plate TP, a filter plate FP is placed which is permeable in an area corresponding to the area where the flow channels DK are provided.

The support plate TP and the filter plate FP resting thereon each have an opening through which a screw connection MK, SG passes which, in the upper part, is formed as a pointed nut head MK with a hexagon head and, in the lower part, is formed as a screw SG with a threaded shaft, the threaded shaft of the screw SG passing through the support plate TP and the filter plate FP resting thereon. The lower end of the screw SG is plane and is a hexagon socket. The screw connection MK, SG, and in particular the pointed nut head MK, forms the displacing member VK by which the solution to be spun is distributed symmetrically inside the housing G towards the nozzle openings DÖ.

Together with the support and filter plates TP, FP, a spinneret plate SP, formed like the bottom of a pot, is placed in the housing opening, which plate has a folded edge. The support, filter and spinneret plates TP, FP and SP are together attached to the housing G by means of a threaded ring GR threaded onto the lower housing part.

The spinneret plate SP comprises an annular region with nozzle openings DÖ. The central part MB of the spinneret plate SP has no openings DÖ and rests with force on the lower surface of the head of the screw SG of the displacing member. The force with which the spinneret plate SP rests on the screw head SG is predetermined by the shape of the spinneret plate SP and is of such a magnitude that the spinneret plate SP will not lose contact with the screw head SG even under the pressure exerted when the solution to be spun is supplied into the housing chamber. Preferably, an elastic joint is interposed between the screw head SG and the spinneret plate SP.

Figure 2:
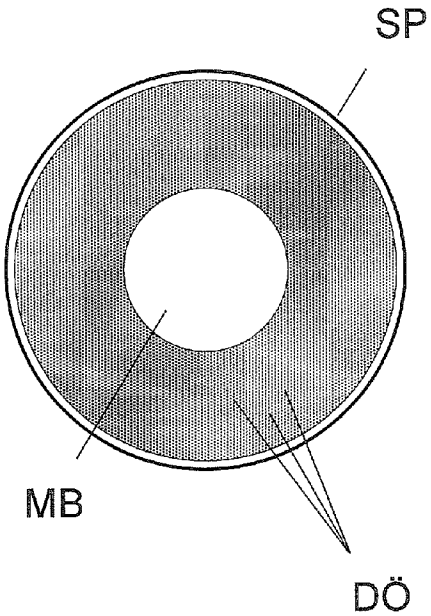
FIG. 2 is a top plan view of a spinneret plate of the wet spinning spinneret of the present invention.

FIG. 2 is a top plan view on the spinneret plate SP with the nozzle openings DÖ arranged in the annular region thereof. The outer diameter of the annular nozzle region is 85 mm, while the inner diameter is 30 mm. In the embodiment illustrated the nozzle diameter is 0.06 mm and the hole distance is 0.643 mm, resulting in 15.6 rows of holes per cm. A total of 12009 nozzles exist in the annular zone that occupies a surface of 49.7 $cm^2$. This results in a nozzle density of 242 nozzles per $cm^2$. The inner surface without nozzle openings thus merely covers 12.8% of the total surface.

Figure 3:
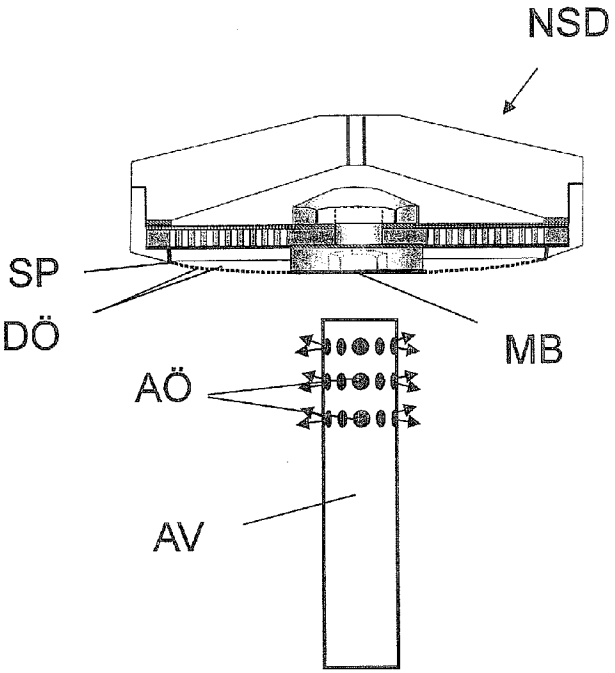
FIG. 3 illustrates a development of the invention in which a flow deflection device in the form of a tube is arranged in the spinning bath opposite the spinneret plate.

FIG. 3 illustrates a development of the invention in which a flow deflection device AV in the form of a tube is arranged in the spinning bath opposite the spinneret plate SP. The tube AV is situated in the central part of the spinneret plate SP that lacks nozzle openings DÖ, i.e. in which no filaments are spun. The end of the tube AV opposite the spinneret plate SP is closed, while the end portion of the tube AV has outlet openings AÖ for the coagulation liquid, the outlet openings AÖ being oriented such that the liquid flows substantially parallel to the surface of the spinneret plate SP, i.e. such that the filaments are flown to perpendicularly. It is thus achieved that the filaments that are spun in the inner zone of the annular nozzle region come into contact with fresh coagulation liquid just as well as the filaments at the outer edge of the spinneret plate SP.

LIST OF REFERENCE NUMERALS

NSD wet spinning spinneret
G housing
Z inlet
TP support plate
DK flow channels
FP filter plate
VK displacing member
MK nut head
SG screw
GR threaded ring
SP spinneret plate
DÖ nozzle opening
MB central region of spinneret plate SP
AV deflection device, tube
AÖ outflow opening

The invention claimed is:

1. A wet spinning spinneret comprising:

a housing which, together with a spinneret plate mounted to the underside thereof, forms a chamber adapted to be supplied with a spinning solution through a spinning solution supply inlet in the housing, the spinneret plate having nozzle openings in at least an annular region, and a displacing member arranged inside the chamber above the spinneret plate, which member directs the spinning solution towards the annular zone, wherein the displacing member is only attached to a support unit arranged upstream of the spinneret plate, seen in the flow direction of the spinning liquid, and wherein the displacing member comprises a first part and a second part, the first part being provided above the support unit and having a free end facing towards the spinning solution supply inlet, and the second part being arranged at the underside of the support unit.

2. The wet spinning spinneret of claim 1, wherein the support unit comprises a support plate with a plurality of flow channels.

3. The wet spinning spinneret of claim 2, wherein the support unit comprises a filter plate configured to have the spinning liquid flown through it arranged upstream of the support plate.

4. The wet spinning spinneret of claim 3, wherein the displacing member comprises a screw connection passing through the support plate.

5. The wet spinning spinneret of claim 4, wherein the first part of the displacing member provided above the support plate is formed as a pointed head of a nut.

6. A wet spinning apparatus comprising the wet spinning spinneret of claim 1, and a flow deflection device configured to be arranged in a spinning bath during a spinning process at a position opposite a central portion of the spinneret plate having no nozzle openings, the flow deflection device being configured to introduce a coagulation liquid into the central portion during the spinning process.

7. The wet spinning apparatus of claim 6, wherein the flow deflection device is shaped as a tube having outlet openings in its shell surface for the coagulation liquid.

8. The wet spinning spinneret of claim 2, wherein the displacing member comprises a screw connection passing through the support plate.

9. The wet spinning spinneret of claim 8, wherein the first part of the displacing member provided above the support plate is formed as a pointed head of a nut.

* * * * *